US010724405B2

(12) United States Patent
Juranitch et al.

(10) Patent No.: US 10,724,405 B2
(45) Date of Patent: Jul. 28, 2020

(54) PLASMA ASSISTED DIRTY WATER ONCE THROUGH STEAM GENERATION SYSTEM, APPARATUS AND METHOD

(71) Applicant: XDI Holdings, LLC, Fort Lauderdale, FL (US)

(72) Inventors: James C. Juranitch, Fort Lauderdale, FL (US); Alan C. Reynolds, Novi, MI (US); Raymond C. Skinner, Coral Springs, FL (US)

(73) Assignee: XDI Holdings, LLC, Bedford, NH (US)

( * ) Notice: Subject to any disclaimer, the term of this patent is extended or adjusted under 35 U.S.C. 154(b) by 97 days.

(21) Appl. No.: 15/152,501

(22) Filed: May 11, 2016

(65) Prior Publication Data

US 2016/0333746 A1 Nov. 17, 2016

Related U.S. Application Data

(60) Provisional application No. 62/160,118, filed on May 12, 2015.

(51) Int. Cl.

| | |
|---|---|
| ***F01K 7/16*** | (2006.01) |
| ***F22B 29/06*** | (2006.01) |
| ***F22B 1/28*** | (2006.01) |

(52) U.S. Cl.

CPC ..... *F01K 7/16* (2013.01); *F22B 1/281* (2013.01); *F22B 29/06* (2013.01)

(58) Field of Classification Search

CPC ..... F01K 7/16; F22B 1/281; F22B 29/06
See application file for complete search history.

(56) References Cited

U.S. PATENT DOCUMENTS

| | | | | |
|---|---|---|---|---|
| 5,161,488 | A * | 11/1992 | Natter | F22B 3/04 122/1 R |
| 2005/0072382 | A1* | 4/2005 | Tippmann, Sr. | F22B 1/284 122/460 |
| 2005/0241311 | A1* | 11/2005 | Pronske | F01K 3/18 60/645 |
| 2006/0249099 | A1 | 11/2006 | Besik | |
| 2010/0115841 | A1* | 5/2010 | Cork | C10B 53/02 48/209 |

(Continued)

FOREIGN PATENT DOCUMENTS

| | | |
|---|---|---|
| EP | 2 546 478 A2 | 1/2013 |
| WO | 2012109537 A1 | 8/2012 |

*Primary Examiner* — Steven S Anderson, II
(74) *Attorney, Agent, or Firm* — Dykema Gossett PLLC

(57) ABSTRACT

A system and method can comprise a heat source, a plasma assisted vitrifier comprising a syphon valve; and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste. The syphon valve is configured to assist in generating a reclaimed product, and the plasma assisted vitrifier is further configured to supply a portion of the process heat to the self-cleaning heat exchanger.

20 Claims, 4 Drawing Sheets

(56) References Cited

U.S. PATENT DOCUMENTS

2012/0279903 A1* 11/2012 Tsilevich ..... E21B 43/24
208/391
2014/0102701 A1* 4/2014 Berruti ..... E21B 36/025
166/272.3
2014/0107234 A1* 4/2014 Lucas ..... C07C 29/1518
518/704
2014/0352634 A1* 12/2014 Sullivan ..... F22B 21/343
122/182.1

* cited by examiner

Detail 300

Detail "A"

PLASMA ASSISTED DIRTY WATER ONCE THROUGH STEAM GENERATION SYSTEM, APPARATUS AND METHOD

CROSS-REFERENCE TO RELATED APPLICATIONS

This application claims the benefit of U.S. provisional application No. 62/160,118, filed 12 May 2015, which is hereby incorporated by reference as though fully set forth herein.

BACKGROUND a. Field

This invention relates generally to a method and system for the generation of steam from dirty water and produced water. The system and method in a preferred embodiment is a Once Through Steam Generation (OTSG) system, apparatus and method an can be a Zero Liquid Discharge (ZLD) system, apparatus and method. The steam product can be used in any steam application but is particularly well suited for Steam Assist Gravity Drain (SAGD) heavy oil applications.

b. Background Art

Once Through Steam Generators (OTSG) are the most common steam generation systems used in SAGD and Cyclic Steam Stimulation (CSS) heavy oil recovery. The heavy oil industry today uses 2 to 4 barrels of water (turned into steam) for every barrel of oil it produces. The oil and gas industry currently utilizes extensive water treatment technologies at the well site to clean its process water before making steam typically in an OTSG. It is a common comment that modern SAGD sites are really a large and expensive water treatment plant attached to a small well pad. The water treatment plant and process currently used in conventional OTSG requires extensive labor and large amounts of expendable chemicals to operate. During normal operations these water treatment plants produce a significant waste stream of lime sludge and other byproducts that must be disposed of Due to the operational expense and capital required to build ever more complete water treatment plants the norm in the oil industry is to limit the steam quality from 70 to 80% in the OTSG. In other words 20 to 30% of the liquid input or feed water stays in a liquid state and is not converted to steam. This practice helps to limit the deposits that will build up inside the OTSG which will eventually disable its operation. To produce a higher quality steam, the water would first have to be treated to a higher purity level adding additional expense and complexity to an already too large and too complex water treatment system. Unfortunately the practice of low quality OTSG steam production is energy inefficient since the spent process water, or blow down, wastes most of its energy without recovering any oil product. This practice produces excessive greenhouse gasses (GHG) from the wasted energy and another waste stream from the OTSG which is the blow down fluid. The amount of blow down produced is significant. The blow down waste contains many contaminated solids such as CAO3 and MGO3. This blow down must be disposed of in deep wells or again run through some very expensive and complex processes to reclaim the valuable water content. The invention taught in this patent eliminates the need for clean water and all its expense. It also eliminates all waste streams including blow down and can in an embodiment be a Zero Liquid Discharge system, a Zero GHG System and a Zero Waste System.

BRIEF SUMMARY

This invention is a system, apparatus and method for the production of steam. It can operate on non-treated dirty water, bitumen production pond water, and salty water. It can also reprocess blow down. It uses fossil fuel, thermal plasma, a self-cleaning heat exchanger and other components to accomplish steam production. In a preferred embodiment the system, apparatus and method can be configured for ZLD operated and produce no waste streams which would need further remediated. In another preferred embodiment the method and system can use highly oxygen enriched air and capture near pure CO2 to be stored and thus eliminating GHG production.

In one embodiment, at least one of a system and method can comprise a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam.

In another embodiment, at least one of a system and method can comprise a heat source, a plasma assisted vitrifier, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste and to supply a portion of the process heat to the self-cleaning heat exchanger.

In yet another embodiment, at least one of a system and method can comprise a heat source, a plasma assisted vitrifier comprising a syphon valve, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste. The syphon valve can be configured to assist in generating a reclaimed product. The plasma assisted vitrifier can be further configured to supply a portion of the process heat to the self-cleaning heat exchanger, and the reclaimed product can comprise at least one of a fiber, an aggregate, a frac sand, and a wall board.

DETAILED DESCRIPTION OF THE EMBODIMENTS

Figure 1:
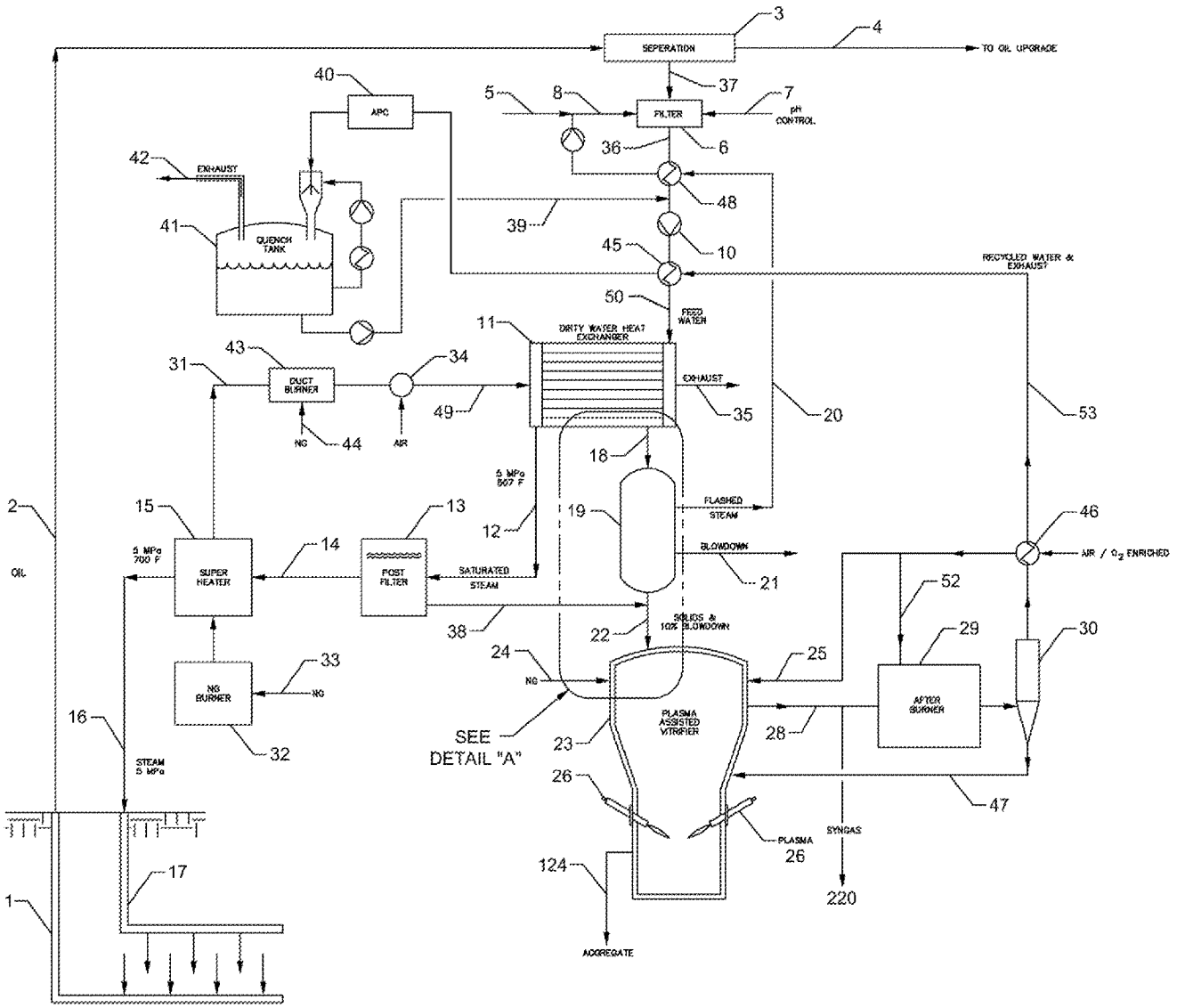
FIG. 1 is a simplified schematic representation of a specific illustrative embodiment of a system and method configured in accordance with the principles of the invention.

Referring first to FIG. 1, a well output 1 can comprise the produced water and bitumen product leg of a SAGD heavy oil operation. The illustrated embodiment comprises a SAGD heavy oil application. The disclosed system and method is not limited to only SAGD applications, but can be used in any application that requires steam generation.

A pipeline 2 carries the materials from the well output 1 to an oil separation system 3. The oil separation system 3 can be implemented in many different ways at many different well sites but in most instances can include a Free Water Knock Out (FWKO) and other heavy oil separation systems known to those skilled in the art. An end product 4 can be the final product of a SAGD operation and, in one embodiment, can comprise an acceptable crude oil that then will be delivered for further processing to a refinery. Other items including a diluant additive, centrifuges, and other bitumen upgrade processes have not been included in FIG. 1 for the sake of clarity.

A separated water output 37 can also be known as "Produced Water" and can be augmented by any required make up water input 5 and fed into a coarse filter 6. A PH control input 7 and other gross water treatments can also occur at this point. A filtered water product 36 can flow through a heat recovery exchanger 48 and into a feed water pump 10. The feed water is converted to saturated steam in a self-cleaning heat exchanger 11 and exits the self-cleaning heat exchanger 11 as a saturated steam output 12 into a post filter 13. The heat exchanger 11 can comprise various systems known in the art. In one embodiment the heat exchanger 11 can comprise a fire tube or water tube design that can be seen in greater detail in FIG. 4. In one embodiment, a post filtered saturated steam output 14 can then be transported to a super heater 15. The super heater 15 can be fired by a first burner 32 or other form of reclaimed energy such as plasma waste heat or other generated heat energy. A Steam product 16 can then enter a well tube 17 in the illustrated embodiment of a SAGD. In other embodiments, post filter 13 can only comprise one output and the post filtered saturated steam output 14 can be combined with a filter waste stream 38. The movement of the filter waste stream 38 is discussed below.

The heat-exchanger waste stream 18 that can be outputted by the self-cleaning heat exchanger 11 can be transported to a separator 19 which can reduce a working steam pressure in the heat-exchanger waste stream 18 from a high pressure to a near ambient pressure. The reduction in pressure in the heat-exchanger waste stream 18 can flash off a majority of the waste water present in the heat-exchanger waste stream 18 which can then be output by the separator 19 into a flashed steam output 20. The flashed steam output 20 can then be condensed completely through a heat recovery exchanger 48 and reintroduced as a filter water input 8 in a distilled water form into the coarse filter 6 to be re-used as feed water. In one embodiment, a blowdown 21 can be expelled and disposed of in a conventional manner. In another embodiment, if a ZLD system and method is desired then the blowdown 21 can be routed through a blowdown conduit 22 into a Plasma Assisted Vitrifier (PAV) 23. Waste from the coarse filter 6 and the filter waste stream 38 from the post filter 13 can also be fed through the blowdown conduit 22 into the PAV 23. Other plasma melt systems such as Alter NRG's coke based plasma melter or Plasco's gas polishing and plasma vitrifying process could also potentially be substituted for the PAV 23 with varying degrees of efficiency and output.

Figure 2:
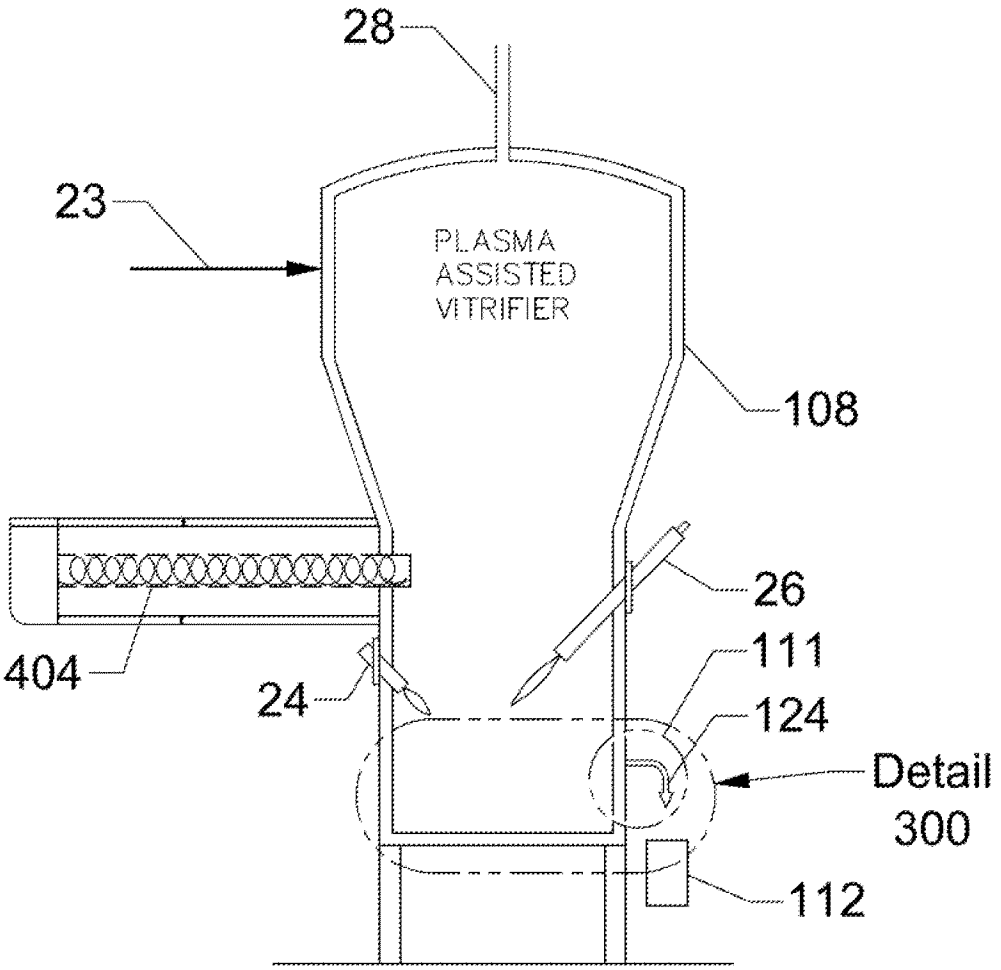
FIG. 2 is an example of a Plasma Assisted Vitrifier (PAV).
Figure 3:
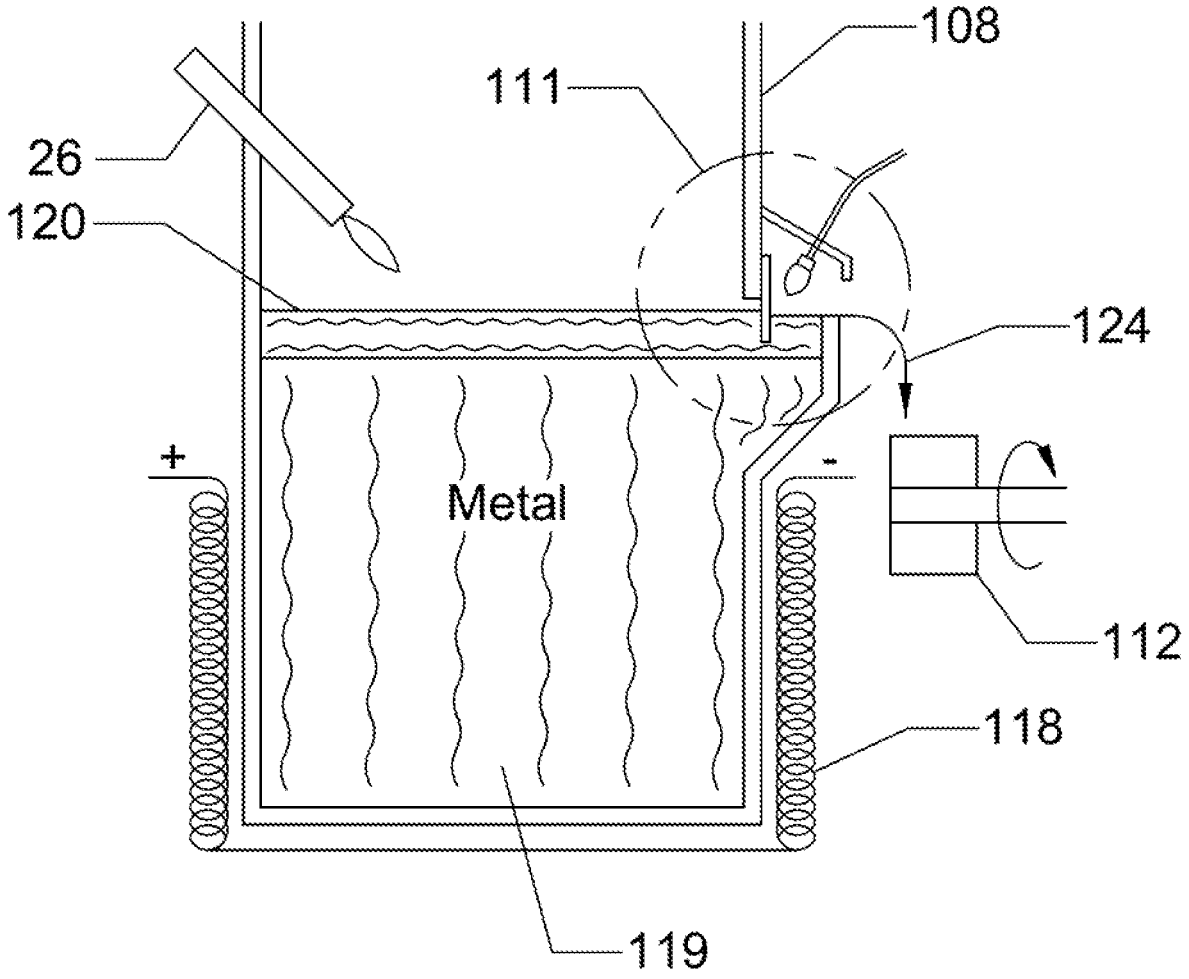
FIG. 3 is a detail of a PAV.

In the preferred embodiment, the blowdown conduit 22 can comprise waste material or feedstock that enters the PAV 23 as shown in FIG. 1. The PAV 23 details are described and taught in international application no. PCT/US2012/024644, filed 10 Feb. 2012 and published in English on 16 Aug. 2012 under international application no. WO 2012/109537 and titled "Inductive Bath Plasma Cupola," (the '644 application) which is hereby incorporated by reference as though fully set forth herein. At least one fossil fueled torch 24 or plurality of torches and at least one plasma torch 26 are also described in the '644 application. One or more of the at least one fossil fueled torch 24 and the at least one plasma torch 26 can be utilized in this system, apparatus, and method. The at least one fossil fueled torch 24 can be operated on, but is not limited to: well head gas, natural gas, propane, diesel, and/or bitumen. A detailed view of the lower section 108 of PAV 23 as shown in FIG. 3 is described in the '644 application and U.S. provisional application No. 62/106,077, filed 21 Jan. 2015, (the '077 application). The '077 application is hereby incorporated by reference as though fully set forth herein. The PAV 23 is further described in FIG. 2. FIG. 2 depicts a preferred embodiment of the PAV 23, where the PAV 23 includes a siphon valve 111 as further described in the '077 application. The preferred embodiment is further shown in FIG. 3 and can comprise a metal thermal pool 119, an inductive furnace 118 and a solids feedstock working area 120. The metal thermal pool 119, the inductive furnace 118, and the solids feedstock working area 120 are further described in the '077 application and can be important to the success of the system and process described herein. However, the metal thermal pool 119, the inductive furnace 118, and the solids feedstock working area 120 are not required for the system and process. A vitrified product 124 can be deposited onto a spinner wheel 120 or, in other embodiments, onto multiple wheels to begin a fiberizing process. In various embodiments, the spinner wheel 120 can be an internal fiberizing process or an external fiberizing process. The spinner wheels of an external fiberizing process and other methods known to those skilled in the art can also be used to manufacture a fracing sand product and other proppants known to those skilled in the art and defined but not limited to ISO 13503-2 or API RP 56/58/60 standards. In addition, forced cooling systems by air or a liquid such as water can be used to manufacture aggregate known to those skilled in the art and defined but not limited to standard specifications ASTM D2940/D2940M-09 and facilitate the separation of reclaimed metals. The metals reclamation process is known to those skilled in the art.

In one embodiment, the PAV system and method as described in FIGS. 1 and 2, is typically operated in a slight pyrolysis mode. The slight pyrolysis mode is maintained by injecting a limited amount of air, or oxygen enriched air, into the PAV 23 through a combustion air input 25. The system and method as described herein can gain efficiency by heating the combustion air present in the combustion air input 25 by optionally using waste heat in a waste heat exchanger 46 operating on reclaimed heat. The same air or oxygen enriched air present in the combustion air input 25 can also be injected into an afterburner 29 through an afterburner conduit 52. If a highly oxygen enriched air in a near stoichiometric ratio is used in the combustion air input 25 and the afterburner conduit 52, a near pure CO2 exhaust can be produced at an exhaust outlet 42. The near pure CO2 that is produced at the exhaust outlet 42 can be then stored in aging SAGD wells or other storage systems to eliminate GHG production. The system can also be operated in a stoichiometric condition or a lean condition with air. However, if this is done, NOx emissions will be more difficult to be cost effectively controlled in a production environment.

Referring back to FIG. 1, a slip stream of syngas product 220 can exit a PAV outlet 28. Diluant and other high value products can be produced using Fisher Tropsch and other known chemical conversion systems or processes known to those skilled in the art in concert with the syngas supply. The afterburner 29 can be part of an emissions attenuation or control process that can also comprise a components particle separator 30 and, in some embodiments, potentially other emissions and exhaust air quality improvement components. The afterburner 29 can operate in series with other emission attenuating components. The other emission attenuation components are illustrated generically as an Air Pollution Control (APC) 40 and a Quench Tank system 41. The APC 40 and the Quench Tank system 41 can operated to control emissions and convert all available organic fuel into heat. In one embodiment, the afterburner 29 can also be boosted in heat energy by injecting a fossil fuel and air, or oxygen enriched air, or oxygen to make more heat energy available for the conversion into super heat for use in the super heater 15 (conduit not shown). The components particle separator 30 can remove particulate from the output of the afterburner 29 to aid in the long term health and efficiency of the waste heat exchanger 46. The PAV outlet 28 can also comprise the slip stream of syngas 220 that can also be used to fire directly in energy generating combustion systems such as an internal combustion engine or gas turbine generator or a combined cycle gas generator systems. This power generation is optional and typically used to self-power the steam generation process.

In one embodiment, a feed dryer system can be run on fossil fuel or waste heat and can optionally be applied to any solids present in the blowdown conduit 22 and used to augment the system and method's efficiency. The feed dryer system is not shown illustrated in the figures of the application, but would be a known system to one of skill in the art.

An exhaust heat of the PAV 23 can be recaptured and used at any point additional heat energy is required. The embodiment shown in FIG. 1 should not be considered the only heat recovery process possible. The Quench Tank system 41 can act to reclaim any condensate in an exhaust within the recycled water and exhaust outlet 53 to aid in the ZLD system design before the PAV exhaust is released at the exhaust outlet 42.

The output from the first burner 32 and a second burner 43 can be reduced in temperature and increased in mass by injecting air or water at a material injection point 34. The injection of air, water, or other material can aid in reducing scaling and organic coking in the self-cleaning heat exchanger 11. The self-cleaning heat exchanger 11 can also be heated in a self-cleaning inlet 49 by a high temperature oil or fluid heat transfer system instead of a burner energy system. The high temperature fluid or oil systems are known by those skilled in the art and are not shown for clarity.

Figure 4:
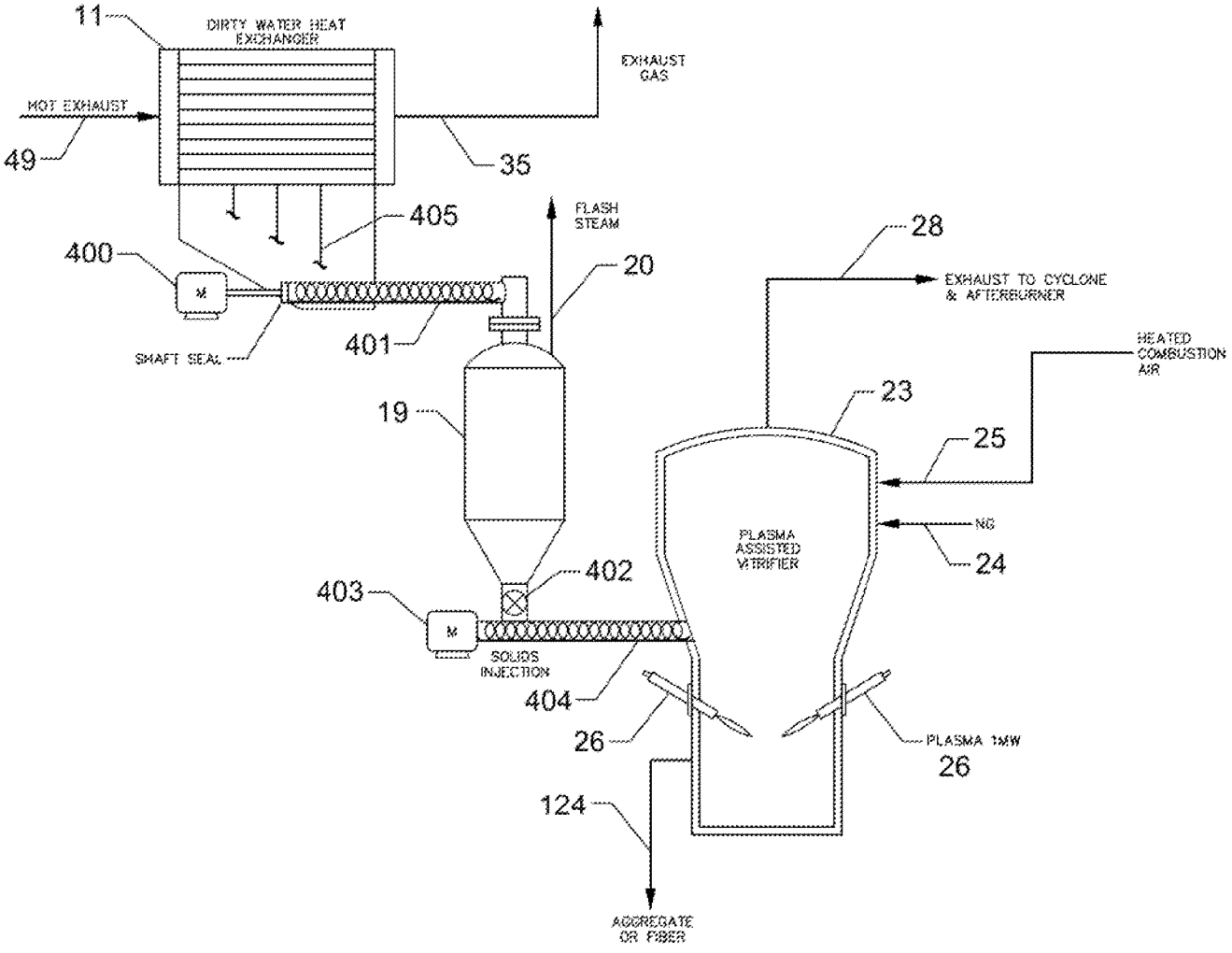
FIG. 4 is Detail A from FIG. 1.

The self-cleaning heat exchanger 11 is shown in more detail in FIG. 4. FIG. 4 shows Detail "A" from FIG. 1. Examples of a self-cleaning dirty water heat exchanger are made by companies such as Klaren which uses an abrasive ball system and Company HRS which uses a scraper system. Heat exchanger debris 405 can comprise organic and inorganic debris and can be separated from a boiler or the self-cleaning heat exchanger 11 and fed by a first lead screw 401 which can be powered by a first motor 400 into a separation tank 19. The separation tank 19 can separate a flash steam output 20 from the debris through an air lock 402 onto a screw feeder 404 powered by a second motor 403. The organic and inorganic material is fed and processed in the PAV 23 as described above and in the '644 and the '077 application which are incorporated by reference above. The above is only one example of a separation and feed system. Many other embodiments are possible.

A complete discussion of the system in FIG. 1 is discussed next. Each of the components of the system in FIG. 1 can be fluidly or otherwise coupled to other components through the lines and arrows illustrated in the figure as would be known by one of ordinary skill in the art. In operation, the embodiment of the disclosure in FIG. 1 can comprise the well output 1 being transported through the pipeline 2 to the oil separation system 3. In the illustrated embodiment, the oil separation system 3 can output two separate products. The end product 4 can be output from the oil separation system 3 and transported to a collection area or separate process to be further refined. Further, the separated water output 37 can also be output from the oil separation system 3. The separated water output 37 can then pass through the filter 6. The filter 6 can comprise 3 inputs and a single output. In the illustrated embodiment, the inputs to the filter can comprise the separated water output 37, the PH control input 7, and the filtered water input 8. The filtered water input 8 can further comprise the required make up water input 5 and the flashed steam 20 from the separator 19. The filter 6 can then output the filtered water output 36. The filtered water output 36 can then pass through the heat recovery exchanger 48 to preheat the filtered product water 36 and remove heat from the flashed steam 20. A quench tank output 39 can then be added to the filtered product water 36. The quench tank output 39 can comprise solids or liquids from the quench tank system 41.

The combined quench tank output 39 and the preheated filtered product water 36 can then be transported to the feedwater pump 10. The feedwater pump 10 can then transport the output of the feedwater pump to an exhaust heat exchanger 45 to transfer heat from the recycled water and exhaust outlet 53. A heat exchanger feed water 50 can exit the exhaust heat exchanger 45 and can be transported to the self-cleaning heat exchanger 11. In the illustrated embodiment, the self-cleaning heat exchanger 11 can comprise two inputs and three outputs. The inputs to the self-cleaning heat exchanger 11 can comprise the heat exchanger feed water 50 and the self-cleaning inlet 49. The self-cleaning inlet 49 can comprise a heat energy to be imparted to the heat exchanger feed water 50. The self-cleaning heat exchanger can exhaust any material introduced through the self-cleaning inlet 49 through a self-cleaning heat exchanger outlet 35. The heat exchanger feed water can be separated within the self-cleaning heat exchanger 11 into the waste stream 18 and the saturated steam outlet 12. The saturated steam outlet can then be transported to the post filter 13. The waste stream 18 can be transported to the separator 19. The separator 19 can take the waste stream 18 and can output a number of streams. In the illustrated embodiment, the separator 19 can output the flashed steam 20, the blowdown 21, and the blowdown conduit 22. In a preferred embodiment, the blowdown 21 is also routed through the blowdown conduit 22.

The materials within the blowdown conduit 22 can be combined with the filter waste stream 38 and transported to the PAV 23. The PAV 23 can then process the materials from the blowdown conduit 22 as described above and can output processed materials through the PAV outlet 28. Further, the vitrified product 124 can also be removed from the PAV 23. The PAV outlet 28 can transport a gaseous output of the PAV 23. The slip stream of syngas 220 can then be removed from the PAV outlet 28 and the remaining materials can be transported to the afterburner 29. The afterburner 29 can combine the output of the PAV outlet 28 with materials transported through the afterburner conduit 52. The afterburner conduit 52 can transport an air or oxygen enriched air over the waste heat exchanger 46 and can then transport the air or oxygen enriched air to the afterburner 29. After exiting the afterburner 29, the resulting materials can be transported to the components particle separator 30. The components particle separator 30 can remove particulate from the output of the afterburner 29 as described above. The components particle separator can then transport any materials separated by the components particle separator 30 through a PAV return 47 so that the solid materials removed from the input to the components particle separator can be re-ran through the PAV 23. The component particle separator 30 can also output recycled water and exhaust material into the recycled water and exhaust outlet 53.

The recycled water and exhaust material can then be transported through the exhaust heat exchanger 45 to impart heat energy to the heat exchanger feed water 50. The recycled water and exhaust material can then be transported to the APC 40 and output from the APC 40 to the Quench Tank system 41. Excess water and any material left within the Quench Tank system 41 can then be transported through the quench tank output 39 as discussed above. An exhaust 42 can then be removed from the system as discussed above. Referring back to the post filter 13, the post filter 13 can couple to the saturated steam output 12 and a saturated steam can be transported from the self-cleaning heat exchanger 11. The post filter 13 can filter the saturated steam and can output the filter waste stream 38 and the post filtered saturated steam output 14. The filter waste stream 38 can then be combined with the materials within the blowdown conduit 22 as discussed above. The post filtered saturated steam 14 can then be transported to the super heater 15. The super heater 15 can then super heat the post filtered saturated steam 14 and output the steam product 16 to the well tube 17. The super heater 15 can also be fed by the first burner 32 that can burn a first natural gas supply 33 or other combustible material. The super heater 15 can exhaust the products of the first burner 32 to the second burner 43. The second burner can be fed by a second natural gas supply 44 and air or water can be injected into the output of the second burner 34 at the material injection point 34. The combined materials can then be transported through the self-cleaning inlet 49 to the self-cleaning heat exchanger 11 as discussed above.

In one embodiment, at least one of a system and method can comprise a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam.

In another embodiment, at least one of a system and method can comprise a heat source, a plasma assisted vitrifier, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to supply a portion of the process heat to the self-cleaning heat exchanger.

In another embodiment, at least one of a system and method can comprise a heat source, a plasma assisted vitrifier, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste and to supply a portion of the process heat to the self-cleaning heat exchanger.

In another embodiment, at least one of a system and method can comprise a heat source, a plasma assisted vitrifier, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste to generate a reclaimed product. The plasma assisted vitrifier can be further configured to supply a portion of the process heat to the self-cleaning heat exchanger, and the reclaimed product can comprise at least one of a fiber, an aggregate, a frac sand, and a wall board.

In yet another embodiment, at least one of a system and method can comprise a heat source, a plasma assisted vitrifier comprising a syphon valve, and a self-cleaning heat exchanger comprising a fired tube side and a water tube side. The self-cleaning heat exchanger can be configured to receive a heat source comprising an oxidized fossil fuel to one of the fire tube side or the water tube side and the self-cleaning heat exchanger can be further configured to receive a dirty water input on the other of the fire tube side and the water tube side to generate a steam. The plasma assisted vitrifier can be configured to process an organic or inorganic solid waste. The syphon valve can be configured to assist in generating a reclaimed product. The plasma assisted vitrifier can be further configured to supply a portion of the process heat to the self-cleaning heat exchanger, and the reclaimed product can comprise at least one of a fiber, an aggregate, a frac sand, and a wall board.

In another embodiment, the above embodiments can be supplemented with an oxygen enriched air used for combustion and a nearly pure CO2 can be collected and stored to minimize GHG production.

In another embodiment, the above embodiments can be supplemented with an afterburner that can be used to extract substantially all available heat energy.

In another embodiment, the above embodiments can be supplemented with a superheater that can be used to improve a steam quality.

In another embodiment, the above embodiments can be supplemented with a quench tank that can be used to reclaim substantially all of a water combustion by product. The quench tank can be further configured facilitate a ZLD facility.

In another embodiment, the above embodiments can be supplemented with a slipstream product syngas that can be used to produce a diluent or other chemical product through a Fisher Tropsch or other style chemical conversion system or process.

In another embodiment, the above embodiments can be supplemented with a slipstream product syngas that can be used to be combusted in an internal combustion generator set. The combustion generator set can be configured to produce energy.

In another embodiment, the above embodiments can be supplemented with a slipstream product syngas that can be configured to be combusted in a simple cycle or combined cycle turbine generator.

In another embodiment, the above embodiments can be supplemented with a heat temperature used to make the steam that can be configured to be reduced and a mass flow that can be configured to be increased by an injection of air or water into the heat source upstream of the self-cleaning heat exchanger.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional.

What is claimed is:

1. A system for the production of steam, comprising:

a self-cleaning heat exchanger comprising a fired tube side and a water tube side, wherein the self-cleaning heat exchanger is configured to receive a heat source comprising an oxidized fossil fuel to one of the fire tube side or the water tube side, wherein the self-cleaning heat exchanger is further configured to receive a combined dirty water input on the other of the fire tube side and the water tube side to generate a saturated steam and a heat exchanger waste stream, wherein the combined dirty water comprises a produced water from a Steam Assist Gravity Drain process, and wherein the self-cleaning heat exchanger outputs the saturated steam and the heat exchanger waste stream from the combined dirty water input and further outputs an exhaust material from the heat source; and a separator, wherein the separator receives the heat exchanger waste stream, wherein the separator is configured to flash off a majority of a water present with the exchanger waste stream, wherein the separator outputs a flashed steam output and a blowdown output, and wherein the combined dirty water further comprises the flashed steam output.

2. The system according to claim 1, wherein an oxygen enriched air is used for combustion and CO2 is collected and stored to minimize greenhouse gas production.

3. The system according to claim 1, further comprising an afterburner configured to extract heat energy.

4. The system according to claim 1, wherein a superheater is configured to improve a steam quality.

5. The system according to claim 1, further comprising a quench tank configured to reclaim substantially all of a recycled water from a component particle separator, wherein the quench tank is further configured to facilitate a Zero Liquid Discharge facility.

6. The system according to claim 1, further comprising a slipstream product syngas configured to be used to produce a diluent or other chemical product through a Fisher Tropsch process.

7. The system according to claim 1, further comprising a slipstream product syngas configured to be combusted in an internal combustion generator set and wherein the combustion generator set is configured to produce energy.

8. The system according to claim 1, wherein a slipstream product syngas is configured to be combusted in a simple cycle or combined cycle turbine generator.

9. The system according to claim 1, further comprising a first burner outputting the dirty water input, wherein a temperature of the dirty water input is configured to be reduced and a mass flow is configured to be increased by an injection of air or water into the first burner upstream of the self-cleaning heat exchanger.

10. A system for the production of steam, comprising:

a heat source;

a plasma assisted vitrifier;

a self-cleaning heat exchanger comprising a fired tube side and a water tube side, wherein the self-cleaning heat exchanger is configured to receive the heat source comprising an oxidized fossil fuel to one of the fire tube side or the water tube side and wherein the self-cleaning heat exchanger is further configured to receive a combined dirty water input on the other of the fire tube side and the water tube side to generate a saturated steam and a heat exchanger waste stream, wherein the combined dirty water comprises a produced water from a Steam Assist Gravity Drain process, and wherein the self-cleaning heat exchanger outputs the saturated steam and the heat exchanger waste stream from the combined dirty water input and further outputs an exhaust material from the heat source; and a separator, wherein the separator receives the heat exchanger waste stream, wherein the separator is configured to flash off a majority of a water present with the exchanger waste stream, wherein the separator outputs a flashed steam output and a blowdown output, and wherein the combined dirty water further comprises the flashed steam output, wherein the plasma assisted vitrifier is configured to process the blowdown output and to supply a portion of the process heat to the self-cleaning heat exchanger.

11. The system according to claim 10, further comprising an afterburner is used to extract heat energy.

12. The system according to claim 10, wherein a quench tank is used to reclaim substantially all of a water combustion by product wherein the quench tank is further configured to facilitate a ZLD facility.

13. The system according to claim 10, further comprising a slipstream product syngas configured to be used to produce a diluent or other chemical product through a Fisher Tropsch process.

14. The system according to claim 10, further comprising a slipstream product syngas configured to be combusted in an internal combustion generator set and wherein the combustion generator set is configured to produce energy.

15. The system according to claim 10, further comprising a first burner outputting the dirty water input, wherein a temperature of the dirty water input is configured to be reduced and a mass flow is configured to be increased by an injection of air or water into the first burner upstream of the self-cleaning heat exchanger.

16. A system for the production of steam, comprising:

a heat source;

a plasma assisted vitrifier;

a self-cleaning heat exchanger comprising a fired tube side and a water tube side, wherein the self-cleaning heat exchanger is configured to receive the heat source comprising an oxidized fossil fuel to one of the fire tube side or the water tube side and wherein the self-cleaning heat exchanger is further configured to receive a combined dirty water input on the other of the fire tube side and the water tube side to generate a saturated steam and a heat exchanger waste stream, wherein the dirty water comprises a produced water from a Steam Assist Gravity Drain process, and wherein the self-cleaning heat exchanger outputs the saturated steam and the heat exchanger waste stream from the combined dirty water input and further outputs an exhaust material from the heat source; and a separator, wherein the separator receives the heat exchanger waste stream, wherein the separator is configured to flash off a majority of a water present with the exchanger waste stream, wherein the separator outputs a flashed steam output and a blowdown output, and wherein the combined dirty water further comprises the flashed steam output, wherein the plasma assisted vitrifier is configured to process the blowdown output, wherein the plasma assisted vitrifier is configured to assist in generating a reclaimed product, wherein the plasma assisted vitrifier is further configured to supply a portion of a process heat of the plasma assisted vitrifier to the self-cleaning heat exchanger, and wherein the reclaimed product comprises at least one of a fiber, an aggregate, a frac sand, and a wall board.

17. The system according to claim 16, further comprising an afterburner is used to extract heat energy.

18. The system according to claim 16, wherein a quench tank is used to reclaim substantially all of a water combustion by product wherein the quench tank is further configured to facilitate a ZLD facility.

19. The system according to claim 16, further comprising a slipstream product syngas configured to be used to produce a diluent or other chemical product through a Fisher Tropsch process.

20. The system according to claim 16, further comprising a slipstream product syngas configured to be combusted in an internal combustion generator set and wherein the combustion generator set is configured to produce energy.

* * * * *